US007543773B2

(12) United States Patent
Lenkl

(10) Patent No.: US 7,543,773 B2
(45) Date of Patent: Jun. 9, 2009

(54) DANCER ARM FOR CONSTANT TENSION

(75) Inventor: Johannes Lenkl, Freising (DE)

(73) Assignee: Avery Dennison Corporation, Pasadena, CA (US)

( * ) Notice: Subject to any disclaimer, the term of this patent is extended or adjusted under 35 U.S.C. 154(b) by 586 days.

(21) Appl. No.: 11/323,326

(22) Filed: Dec. 30, 2005

(65) Prior Publication Data

US 2007/0131814 A1 Jun. 14, 2007

(30) Foreign Application Priority Data

Dec. 9, 2005 (DE) ..... 10 2005 058 964

(51) Int. Cl.
*B65H 23/18* (2006.01)

(52) U.S. Cl. ..... 242/417.3; 242/413.3

(58) Field of Classification Search ..... 242/417.3, 242/417.6, 413.6, 416, 417, 563, 423.1, 421.2, 242/413.3; 156/542, 494, 495, 496, 384, 156/387; 226/44
See application file for complete search history.

(56) References Cited

U.S. PATENT DOCUMENTS

| | | | | |
|---|---|---|---|---|
| 3,547,369 | A | 12/1970 | Potucek | |
| 3,904,147 | A | 9/1975 | Taitel et al. | |
| 3,923,199 | A | 12/1975 | Real | |
| 4,351,690 | A * | 9/1982 | George | 156/384 |
| 4,547,250 | A | 10/1985 | Murayama | |
| 5,176,334 | A | 1/1993 | Dreschau et al. | |
| 6,807,998 | B2 * | 10/2004 | Dods | 156/541 |
| 6,823,916 | B2 * | 11/2004 | Dods | 156/378 |
| 6,845,800 | B2 | 1/2005 | Dods et al. | |
| 2004/0206847 | A1 * | 10/2004 | Schanke et al. | 242/423.1 |
| 2007/0131814 | A1 | 6/2007 | Lenkl | |
| 2008/0048060 | A1 * | 2/2008 | Kessler | 242/563 |

FOREIGN PATENT DOCUMENTS

| | | | |
|---|---|---|---|
| CH | 691231 | A5 | 5/2001 |
| DE | 1953552 | U | 1/1967 |
| DE | 4019108 | A1 | 12/1991 |
| DE | 10321267 | A1 | 1/2005 |
| DE | 102005058964 | A1 | 6/2007 |
| GB | 1136261 | | 12/1968 |
| GB | 1195767 | | 6/1970 |
| JP | 9104425 | | 4/1997 |
| JP | 9104425 | A | 4/1997 |

* cited by examiner

*Primary Examiner*—William A Rivera
(74) *Attorney, Agent, or Firm*—Joseph J. Grass

(57) ABSTRACT

The invention relates to an apparatus for maintaining a constant tension on a web of material, in particular on a label web used in a labeling machine (E), said apparatus comprising: a stationary rotary axle device (30) with a geometric rotational axis (M) and a tension compensation device (40) rotatable from a starting position about said rotational axis (M) of said rotary axle device (30), said tension compensation device (40) comprising a force unit (60) which exerts a force on the tension compensation device (40) that counteracts the rotational movement of the tension compensation device (40) from the starting position. It is further provided that the force applied by the force unit (60) is a linear force acting on the tension compensation device (40) at a force application point (65) with a radial spacing to the rotational axis (M) of the rotary axle device (30).

38 Claims, 4 Drawing Sheets

46

DANCER ARM FOR CONSTANT TENSION

CROSS-REFERENCE TO RELATED APPLICATION

Figure 1:
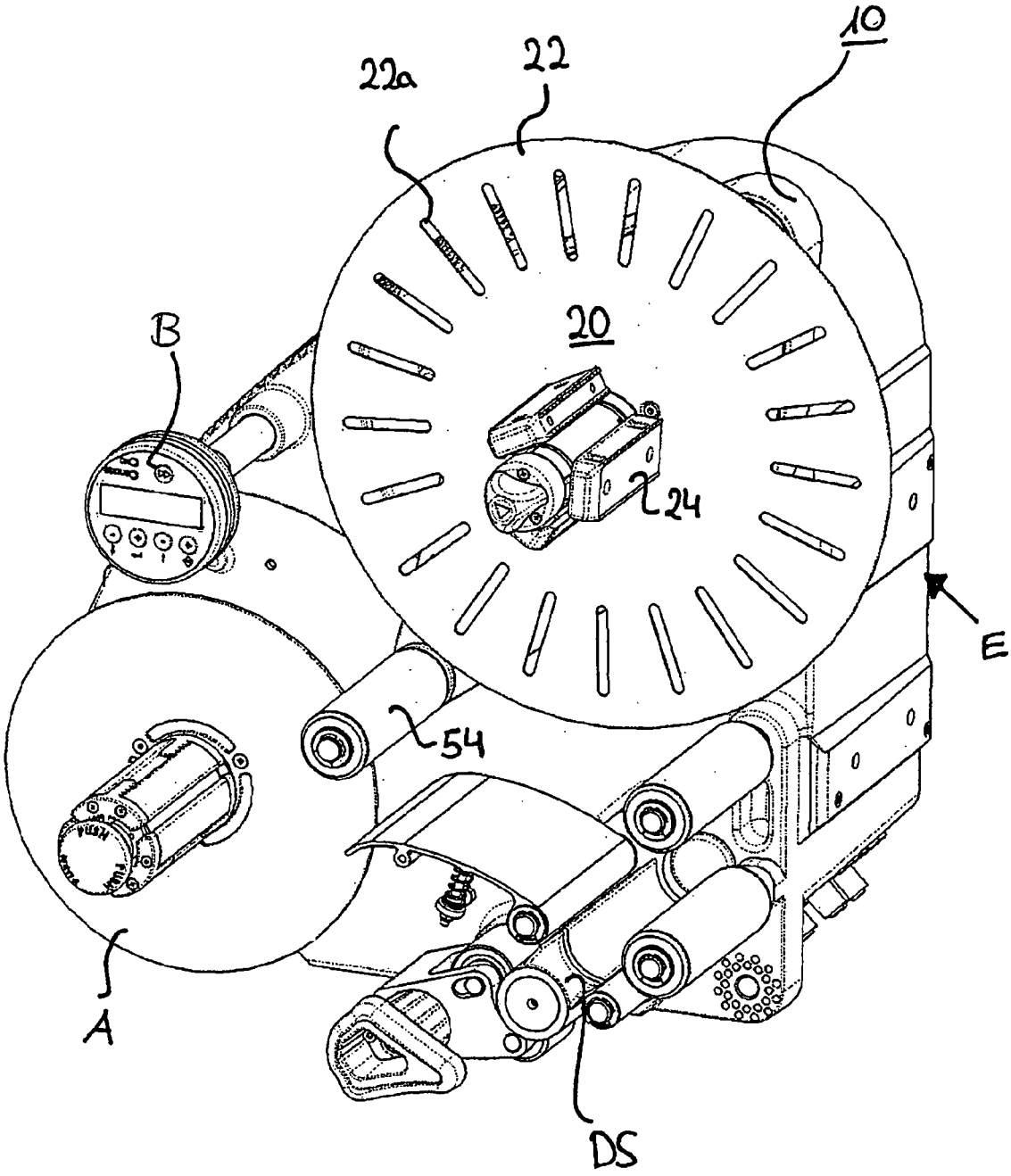

This application claims priority of German Patent Application Number DE 10 2005 058 964.2, filed on Dec. 9, 2005.

The present invention relates to an apparatus for maintaining a constant tension on a web of material, in particular on a label web used in a labeling machine, pursuant to the generic portion of claim 1.

In practice, it is often necessary to keep the tension acting on a transported web of material at least approximately constant. This is the case, for example, with labeling machines by means of which self-adhesive labels, inter alia, are drawn from a label carrier web and precisely positioned on products to be labeled. The label carrier web is wound on a roll and is drawn from same by means of drive rollers disposed downstream from the label roll, and fed to the dispensing edge of the labeling machine where the labels are detached from the label carrier web. The labels may be unprinted or pre-printed. In the former case, there is also a printing station disposed upstream from the dispensing edge.

When a label roll is being used, its diameter decreases such that the weight of the label roll is reduced, thus causing the inertia and/or the angular momentum of the label roll to decrease. However, the inertia has a strong influence on the precision of the application process, i.e. on the precision when applying the label to a product moving past the dispensing edge. The speed of the product may be up to 40 m/s, for example, so it is necessary to accelerate the label web and hence also the label roll to this speed from a standstill. Although the initial inertia can be taken into account when adjusting the labeling machine at the start of using the label roll, the inertia changes with increasing use of the label roll, as already mentioned.

It is known in practice that a so-caller dancer arm can be interposed between the label roll and the dispensing edge past which the label carrier web is guided, in order to provide some form of compensation for the change in tension that likewise results when the diameter of the label roll changes, with the consequences described in the foregoing. Said dancer arm can be a pivotable lever which is rotatably attached at one end to the housing of the labeling machine and provided at its other end with a roller about which the label carrier web is fed. Said dancer arm is also biased to its starting position by a torsion spring. When the tension on the label carrier web is increased, the dancer arm is pivoted out of its starting position against the spring force of the torsion spring and counteracts that force with increasing deflection torque the more it is pivoted from the starting position.

It has been found to be disadvantageous in this context if the resistance with which the dancer arm compensates any changing and particularly any increasing tension is not constant across its entire range of movement, which then results in the tension on the label carrier web likewise being non-constant. Furthermore, the service life of a torsion spring is minimal by comparison, so the torsion spring must be replaced after a short time, or breaks during operation with the result that the labeling machine can no longer be used. The torsion spring is also a relatively complicated component that increases the total cost of the labeling machine due not only to the work on the labeling machine that is necessary to fit the spring, but also to its relatively expensive procurement.

The object of the present invention is to provide an apparatus of the kind initially specified that is simple in structure and delivers a cost-efficient tension compensation solution.

This object is achieved by the features of claim 1. Advantageous configurations of the invention are described in the subsequent claims 2-38.

The embodiment of the apparatus according to the invention for maintaining a constant tension on a web of material, preferably on a label web used in a labeling machine, comprises: a stationary rotary axle device with a geometric rotational axis and a tension compensation device rotatable from a starting position about said rotational axis of said rotary axle device, said tension compensation device comprising a force unit which exerts a force on the tension compensation device to counteract the rotational movement of the tension compensation device from the starting position. The force applied by the force unit is a linear force acting on the tension compensation device at a force application point with a radial spacing to the rotational axis of the rotary axle device.

This makes it possible for the tension compensation device to have a very simple and hence very cost-efficient structure. It is a general principle that force generating devices which produce a linear force can be very simple in design and can be manufactured cost-efficiently. In addition, the mounting devices that must be provided in the tension compensation device in order to mount the force unit are equally simple in structure, thus reducing the total cost of the equipment with which the apparatus according to the invention is used. The tension that is induced by the apparatus according to the invention and which compensates for the tension exerted on the web of material by the equipment in which the apparatus according to the invention is deployed, and which can change for various reasons during the life of the web of material, as mentioned above, is produced by a torque that counteracts the rotational movement of the tension compensation device out of its starting position. In other words, by means of the relatively simple force unit generating a linear force, and the spacing between the force application point of said force unit and the rotational axis of the rotary axle device, a torque is generated that counteracts the movement of the tension compensation device out of its starting position.

It is advantageous in this connection when the force unit can be pivoted at the force application point relative to the tension compensation device. The path traveled by the force unit may differ from the path traveled by the coupling point where the force unit is coupled to the tension compensation device. If the other attachment point is kept stationary, but about which the force unit can also be pivoted, it is possible for the force unit to be actuated when the tension compensation device is pivoted.

One inventive idea in the present proposal consists in lines of action of the force produced by the force unit enclosing an angle with the straight lines defined by the rotational and central longitudinal axis as well as the force application point of the force unit, said angle preferably being in a range between 0° and 90° and in particular in the range greater than 90° and smaller than 90°. If the angle between the line of linear force produced by the force unit and the radial spacing between the rotational axis and the force application point is variable, it is possible to control the components of the force produced by the force unit and which can induce a torque on the tension compensation device, in such a way that the resultant torque remains constant. It is particularly preferred that the angle between the line of force of the linear force produced by the force unit and the radial spacing between the rotational axis and the force application point is continuously modified and/or decreases.

As a basic principle, the apparatus according to the invention can be used in cases where the varying tension on the web of material is known throughout use of the web of material.

For example, if it is found in prior testing that the tension acting on a web of material over the duration of use decreases with increasing use, it is possible, by appropriately configuring the apparatus of the invention, for the amount of tension produced by the force unit, or the amount of torque produced by the force unit to increase accordingly. The converse is also true.

The varying force produced by the force unit can be controlled, firstly, by the force unit itself, as mentioned again below. However, there is also the option of inducing a change by changing the geometry of the force components. It is thus conceivable, for example, that with an appropriate configuration those components of the force produced by the force unit which induce a torque acting on the tension compensation device can vary across the pivoting and/or rotating range of the tension compensation device, whereupon the torque then changes in turn. The size of these force components can both increase or decrease, in general, and a combination of increasing and decreasing size is also possible. However, it is preferred that the size of the components of the force produced by the force unit and inducing the torque acting on the tension compensation device remains at least approximately identical, and hence that the size of the resultant torque likewise remains at least approximately constant.

In addition or alternatively, it is likewise possible to arrange for the spacing or support spacing between the rotational axis of the rotary axle device and the force application point at the tension compensation device to change at least partially through the rotational movement of the tension compensation device. Changing the spacing causes a change in the torque induced by the force of the force unit, said torque counteracting the rotational movement of the tension compensation device from its starting position as a consequence of the tension acting on the web of material. In the same manner, by changing the spacing it is also possible to compensate for any change in the size of the force components inducing the torque, such that overall the torque resulting from said force components and the spacing remains at least approximately constant. It is particularly advantageous in this context when a continuous change in the spacing between the rotational axis and the force application point is effected over almost the entire rotational movement of the tension compensation device, at least. As has already been described, the size of the force produced by the force unit can increase progressively or degressively or linearly. In the case of progressive or linear increase, it is particularly advantageous when the spacing between the rotary axle and the force application point decreases during the rotational movement of the tension compensation device, starting from its starting position.

If the time curve of the tension acting on the web of material during the duration of use is unknown or varies, i.e. the tension increases or decreases, then a solution can be also be provided in which the size of the force produced by the force unit changes over the duration of use. Examples of such force units are springs that have a nonlinear spring rate, be it progressive or degressive.

Combining such a force unit with the idea referred to above, namely to have a variable angle between the line of force along which the force produced by the force unit acts linearly, and the support spacing between the force application point and the rotary axle, provides the option of supplying an at least approximately constant torque that counteracts the tension acting on the web of material. These can be matched in such a way that the angle is changed with increasing size of the force produced by the force unit. In other words, by means of the pivotable coupling to the tension compensation device of one and the same force unit producing a linear force, one achieves a situation in which, despite the increasing size of the linear force produced by the force unit, the torque acting on the tension compensation device remains at least approximately constant, because by changing the aforementioned angle, the specific force component inducing the torque remains constant. This can be achieved by giving the system an appropriate geometric configuration, as will be explained in further detail in the following.

As has been described in the foregoing, it is possible to change the size or amount of the torque that counteracts the rotational movement of the tension compensation device out of its starting position when the tension on the web of material increases, by changing the size of the specific torque-inducing component of the force produced by the force unit, and/or by changing the spacing between the force application point and the rotational axis. A prerequisite is that there is no change in the size of the force produced by the force unit itself, but that, by means of an appropriate geometric configuration, there is a change in the size of the specific component of said force that induces the torque. As has likewise been described in the foregoing, this change in torque force component can be achieved by changing the angle between the force components into which the force produced by the force unit can be resolved in a parallelogram of forces. However, the apparatus according to the invention also makes it possible to keep constant the size of the force component that induces the torque, or the spacing between the force application point and the rotary axle, and instead to change the size of the force produced by the force unit at least section by section along the path of rotational movement of the tension compensation device. Here, too, it is preferred that the size of the force produced by the force unit changes continuously and preferably increases during the rotational movement of the tension compensation device. As likewise described above, a special inventive idea in the present proposal consists in not only changing the size of the specific component of the force produced by the force unit that induces the torque, or in changing the spacing between the rotational axis and the force application point, or changing the size of the force produced by the force unit, but that both changes are coordinated with each other. This can be done, for example, by using as the force unit a machinery element that generates a linear force which increases progressively or linearly with increasing load. A degressive decrease is also possible, of course. Such a machinery element is provided, for example, by a compression spring with a progressive spring rate.

The linear force produced by the force unit can be both a compressive and a tensile force. Given that force units which produce a compressive force often have a longer service life compared to force units which generate tensile forces, the particularly preferred apparatus according to the invention is one in which the force produced by the force unit is a compressive force.

A wide diversity of machinery elements can be used for the force unit. One possibility, for example, is for the force unit to be formed by at least one spring, preferably a compression spring that preferably has a nonlinear, and in particular a progressive spring rate. Another possibility is for the force unit to be formed by at least one gas pressure spring or at least one electromagnet. It is also possible, of course, to use any other solution for the force unit by means of which a linear force can be produced.

One particularly simple configuration of the tension compensation device with regard to the force application point of the linear force produced by the force unit, and its spacing from the rotational axis of the rotary axle unit, can be achieved by having the tension compensation device rotatable about the rotational axis of the rotary axle device, and having the force application point eccentric to the rotational axis of the rotary axle device. The force unit can be supported at the force application point of the tension compensation device, on the one hand, and at a force application point of an attachment unit, on the other hand.

If the force unit is a compression spring element, for example, it is advantageous if the force unit is pivotably attached at its attachment or force application point to the tension compensation device. If an attachment unit is additionally provided, it is also advantageous if the force unit is pivotably coupled with its attachment or force application point to said attachment unit and/or to the tension compensation device.

If the web of material whose tension is to be kept at least approximately constant is rolled up to form a roll, it is also advantageous if at least one unwinding unit mounted onto the rotary axis device and rotatable about said device is provided. It is also advantageous here if the unwinding unit is attached in an axially rigid manner to the rotary axle device.

In order to reduce the influence of any slip that might occur between the unwinding unit and the web of material rolled up into a roll, it is also advantageous if the unwinding unit has fastening means for preferably non-slip, reversible fastening of the roll of material.

To ensure that the unwinding unit does not move automatically, for instance when the web of material has come to a standstill, another advantageous configuration of the present invention consists in providing a stationary brake unit whose breaking power preferably acts on the unwinding unit. However, said stationary brake unit can also act, of course, on a different device or unit in the apparatus according to the invention.

Since the tension compensation device is in its starting position, particularly at the beginning of any forward movement of the web of material, and any unintended movement of the web of material is to be avoided in this position, it is advantageous if the brake unit is in its braked position when the tension compensation device is in its starting position.

The brake unit can be actuated by both active and passive elements. An example of an active element is a motoric drive, for example a hydraulic cylinder. An example of a passive element is a solution in which actuation of the brake unit is derived from rotational movement of the tension compensation device. In such a case, it is also preferred if the brake unit is reversibly movable from its braked position into its released position by means of at one actuating element connected for motion and transmission of motion to the tension compensation device. Said actuating element can communicate with the tension compensation device in such a way that the actuating element is actuated by the rotational movement of the tension compensation device.

The brake unit should also be simple in structure. When using an actuating element, this aim can be achieved by having the actuating element act directly on a brake shoe of the brake unit. In order to have the possibility of controlling the movement of the brake shoe according to the rotational position of the tension compensation device in a preferably variable manner, the actuating element can take the form of a cam element whose cam surface preferably has a profile that is continuous, but with uneven radii of curvature, for example.

One particularly simple way of actuating the brake unit is to configure the brake unit such that it can be released from its braked position when the rotational movement of the tension compensation device begins. It is also advantageous in this context when the brake unit is continuously released from its brake position.

As already mentioned above, the brake unit can be actuated by active elements, for example by a hydraulic cylinder. However, as explained at the outset, it is desirable with such devices for maintaining an at least approximately constant tension that these are simple and therefore cost-efficient in structure. In such a case it is advantageous when the brake unit is biased in its braked position using at least one biasing element. It can also be advantageous when the biasing force of the biasing element is matched to the force produced by the force unit such that the biasing force can be added to the latter force. If the force unit is a compression spring, for example, such a spring will generally produce only a very small force at the start of its spring deflection. This initial gap in the force variation of the force unit can then be bridged by the biasing element of the brake unit.

A wide variety of machinery elements can be used to bias the brake unit. It is advantageous when the biasing force can be applied to the brake unit by means of a spring element, preferably a tension spring.

Various solutions can be provided with regard to the structure of the brake unit. On particularly simple design of the brake unit can be achieved when the brake unit is in the form of a shoe-type brake of which at least one brake shoe is rigidly connected to the rotary axle device, said brake shoe preferably acting upon a brake drum connected non-rotatably to the unwinding unit (20). The brake drum can be rotatably disposed concentrically to the rotational axis of the rotary axle device (30), and the brake unit can comprise two brake shoes arranged symmetrically to the brake drum. As already mentioned, the brake shoes are biased by at least one tension spring into the braked position of the brake unit.

To protect the force unit for applying the linear force against damage, it is possible to provide the tension compensation device with a housing that encloses parts of the rotary axle device and/or the force unit at least partially. It can also be arranged for the rotational axis of the rotary axle device to be located inside said housing. Such an arrangement allows the weight distribution of the tension compensation device to be symmetrical in respect of the rotational axis of the rotary axle device. By this means, it is possible for the tension compensation device to be configured in such a way that it can be disposed at any position inside the machine in which it is used.

The housing can have any shape. It is particularly preferred if, in a plan view, the housing has the shape of a rectangle, preferably the shape of a rhombus, and preferably also the shape of a kite. The intersection point of the diagonals of the rectangle can lie on the rotational axis of the rotary axle device.

Figure 2:
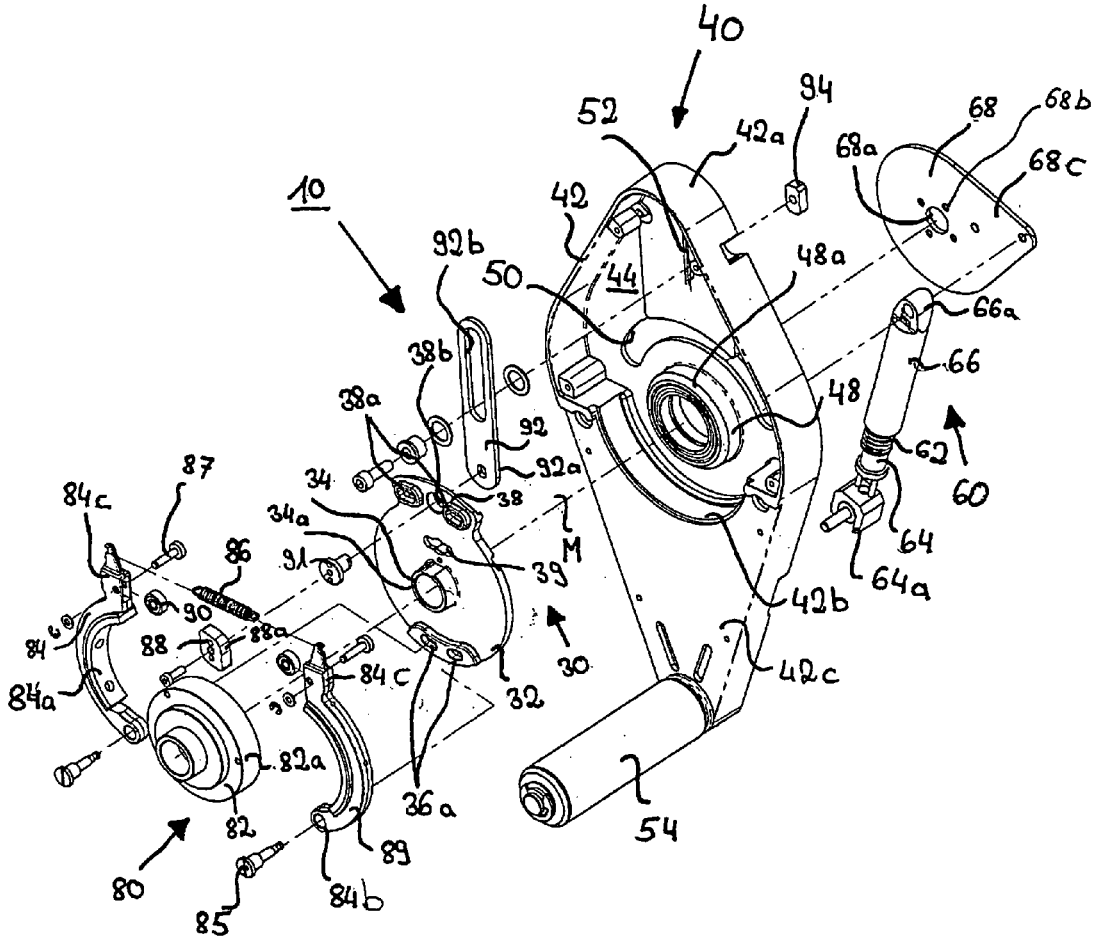
Figure 3:
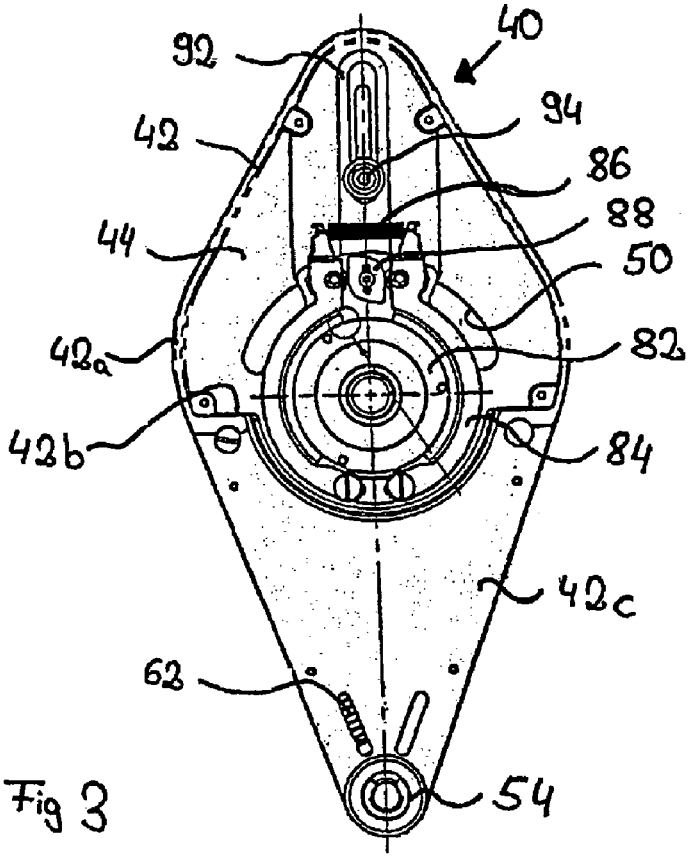
Figure 4:
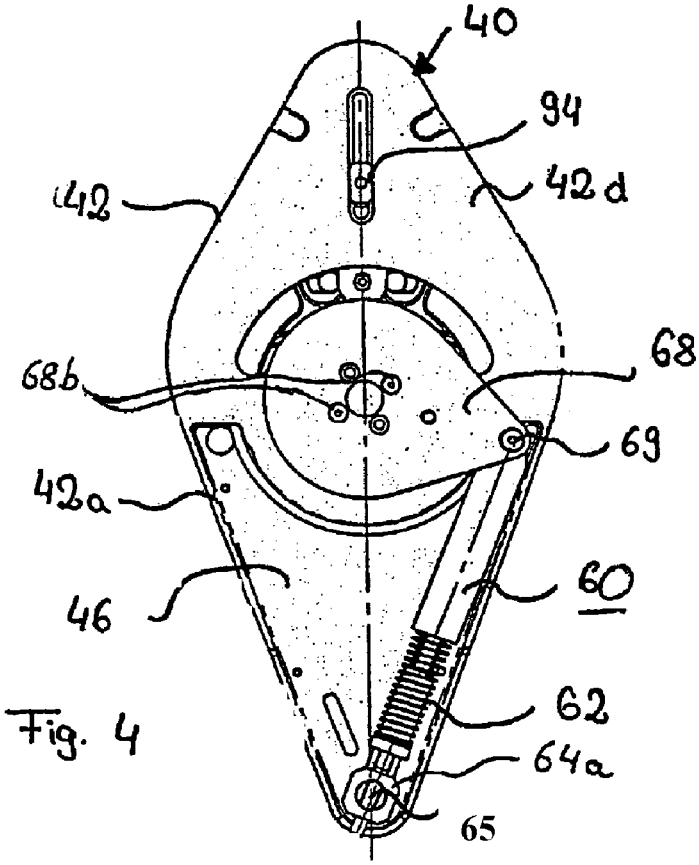

Other advantageous configurations and an embodiment of the apparatus according to the invention shall now be described with reference to the Figures. It should be noted that the terms "right", "left", "top" and "bottom" used during the description relate to the drawings oriented in such a way that the reference numerals and figure references are readable in a normal way. The drawings show:

FIG. 1 a perspective view of a labeling machine with which the apparatus according to the invention is used;

FIG. 2 a perspective exploded view of the apparatus according to the invention;

FIG. 3 an assembly drawing of the apparatus according to the invention, viewed from its front side;

FIG. 4 an assembly drawing of the apparatus according to the invention, viewed from its rear side; and FIGS. 5*a*-5*f*: various views of the apparatus according to the invention, viewed from the front and rear side in different operating positions.

FIG. 1 shows a perspective view of a labeling machine E in which the apparatus 10 according to the invention is used to maintain an at least approximately constant tension on a web of material—in this case a label carrier web. Said labeling machine E also comprises, in addition to the apparatus 10 according to the invention, a printer/dispensing unit DS disposed below the apparatus 10 of the invention. The labeling machine E further comprises a winding unit A, onto which is wound the empty label carrier web, i.e. the carrier web after the single labels have been removed at the printer/dispensing unit DS. If the labels have already been printed, then a dispenser unit only can be provided in place of the printer/dispensing unit DS. Finally, the labeling machine E has an operating panel B by means of which operating commands can be entered into the labeling machine E and, if necessary, the operating state of the labeling machine E can be read out.

The label carrier web, not shown, is guided from an unwinding unit 20 to the left and downward to a deflection roll 54, not described in any further detail, of the apparatus 10 according to the invention, and from there to the printer/dispensing unit DS over additional rollers, not described, one or more of said rollers being drive rollers. At the printer/dispensing unit DS, the single labels on the label carrier web can be either printed and subsequently dispensed, or only dispensed if they have already been printed. As already mentioned, the empty label carrier web is then guided at the printer/dispensing unit DS to the left and rearward to the winding unit A.

As can be seen from FIGS. 1-3, in particular, the apparatus 10 according to the invention for maintaining the tension of a web of material at least approximately constant has as its main components: a winding unit 20 for keeping the tension of a web of material at least approximately constant, a rotary axle device 30, a tension compensation device 40, a force unit 60 and a brake unit 80. These main components shall now be described in greater detail with reference to FIGS. 1-4.

The unwinding unit 20 has a stop disk 22 disposed in a vertical orientation in FIG. 1, and which has a circular shape in the plan view from the front. To save weight, stop disk 22 is provided with slots 22*a* that are spaced apart from the outer perimeter of stop disk 22 and extend radially inwards in the form of rays. As can be seen from FIG. 1, the radial length of slots 22*a* is significantly smaller than the radius of stop disk 22. The unwinding unit 20 also has fastening means 24 that allows slip-free fastening of a label carrier web wound onto a roll. Fastening means 24 has a normal structure and for that reason is not described in any further detail.

The rotary axle device 30 has a rotary axle non-rotatingly mounted to the housing, not shown in any further detail, of labeling machine E, or to the housing of any other equipment with which apparatus 10 according to the invention is used; in FIG. 2, only the geometric rotational and central longitudinal axis M of the rotary axle is shown. The axle can be made, for example, of steel and the like. In the arrangement of the apparatus 10 of the invention attached to labeling machine E, as shown in FIG. 1, the rotational axis of the rotary axle device 30 projects at least approximately perpendicularly from the vertical plane of the housing, not separately indicated, of labeling machine E, and extends substantially horizontally. However, due to apparatus 10 being specially configured according to the invention, as described below in greater detail, the rotational and central longitudinal axis M of the rotary axle and/or the rotary axle itself can adopt any other position. It should also be noted that the cross-section of the rotary axle is at least approximately circular in shape.

As can be seen from FIG. 2, in particular, the rotary axle device 30 also has an essentially plane support plate 32 made of precision cast steel, which is connected non-rotationally and axially rigidly to the rotary axle of the rotary axle device 30. In the plan view, support plate 32 has at least approximately the shape of an inverted Greek letter "Ω". The thickness of support plate 32 is very much smaller than its diameter. Support plate 32 is for attaching and supporting components of the brake unit 80, as is explained in greater detail below.

When the apparatus 10 according to the invention is fully assembled, support plate 32 also has a central through hole 34 at its geometric center, concentric to the rotational and central longitudinal axis M and having a circular shape in the plan view, said through hole having a integral rim 34*a* of uniform height projecting to the left. The rotary axle of the rotary axle device 30 is inserted through said through hole 34.

At its lower edge, support plate 32 also has a raised portion or material reinforcement 36. Said material reinforcement 36 has two through holes 36*a* that in the plan view each have the shape of an oval that lies slightly tilted in the circumferential direction of support plate 32, and which are used to mount components of brake unit 80. The two through holes 36*a* are symmetrically arranged on either side of a line or axis of symmetry, not shown, of support plate 32, said line or axis of symmetry extending vertically and passing through the center of support plate 32.

On the side of support plate 32 diametrically opposite material reinforcement 36, there is provided on support plate 32 an extension 38 that extends radially outwards and which gives rise in particular to the characteristic "Ω" appearance of support plate 32. This extension 38 likewise has two longitudinal through slots 38*a* that in the plan view each have the shape of an oval that lies slightly tilted in the circumferential direction of support plate 32 and which are used to mount components of brake unit 80. The longitudinal extension of the two longitudinal slots 38*a* in the circumferential direction of support plate 32 is greater than that of the two oval through holes 36*a* in material reinforcement 36. Like the two through holes 36*a* in material reinforcement 36, the two longitudinal slots 38*a* in extension 38 are symmetrically arranged on either side of a line of symmetry, not shown, of support plate 32, said line of symmetry extending vertically and passing through the center of support plate 32.

On extension 38 there is also provided an additional through hole 38*b* that is circular in shape in the plan view, whose center lies on the aforementioned vertical line of symmetry and which is disposed between the two longitudinal slots 38*a*.

It should also be noted that another through hole 39 is disposed between the center through hole 34 and extension 38, spaced apart from both the center through hole 34 and extension 38, but closer to the center through hole 34. This additional through hole 39 is shaped at least approximately like a keyhole lying on its side for a double-beard key and is for mounting control and/or monitoring elements such as photoelectric barriers, for example. Said elements can be used, for example, to detect the direction of rotational movement of the label roll, the rotational speed of the label roll, the reduction in diameter of the label roll, etc.

The tension compensation device 40 includes, firstly, a housing 42, which can be fabricated from diecast aluminum or precision cast steel. In the plan view, housing 42 has the shape of a rhombus, in particular the shape of a kite with rounded corners that is symmetrical about the longer of its two diagonals. The isosceles triangle of housing 42 under the shorter of the two diagonals intersecting at right angles, i.e. under the horizontal diagonal, has a greater height than the isosceles triangle above the shorter, horizontal diagonal.

Housing 42 also has openings 44, 46 on its front side and rear side, respectively, each of which is enclosed by an at least approximately perpendicular rim 42*a* projecting out of the plane of housing 42. The first opening 44 on the front side of housing 42 covers, with the exception of rim 42*a*, the entire area of the upper isosceles triangle of the kite-shaped housing 42 and serves to receive components or assemblies of rotary axle device 30 and brake unit 80, as will be described in greater detail below. Opening 44 also extends beyond the shorter of the two diagonals of the kite intersecting at right angles into the area of the lower isosceles triangle.

Opening 44 is confined by a substantially horizontal partition 42*b*. As can be seen from FIG. 2, partition 42*b* extends horizontally at first from one of the two opposite rims 42*a* of housing 42 before continuing in a downwardly extending arc, not described in further detail, and ending in another horizontal portion of partition 42*b* that is likewise not described in further detail. The arc segment is disposed between the two horizontal portions of partition 42*b* symmetrically about the vertical axis of symmetry of kite-shaped housing 42. From partition 42*b*, housing 42 continues downwards from the level of partition 42*b* with an at least approximately plane surface 42*c* that forms the bottom of the second opening 46 on the rear side of housing 42.

The second opening 46 provided on the rear side of housing 42 is for receiving various components or assemblies of the force unit 60, as is described in greater detail below. With the exception of rim 42*a* and that portion of the first opening 44 that extends beyond the shorter of the two diagonals of the kite intersecting at an angle of 90°, the second opening 46 covers the surface of the lower isosceles triangle of kite-shaped housing 42. The second opening 46 is confined at the top by partition 42*b*. Housing 42 continues upwards from the level of partition 42*b* with an at least approximately plane surface 42d that covers the entire surface of the upper isosceles triangle of kite-shaped housing 42 and forms the bottom of the first opening 44 on the front side of housing 42.

The tension compensation device 40 also has a through hole 48 that is circular in shape in the plan view, whose center is located on the vertical axis of symmetry of kite-shaped housing 42, spaced apart below the point where the diagonals of the kite intersect at right angles. The rotational axis of the rotary axle device 30 is guided concentrically through through hole 48. As can also be seen from FIG. 2, through hole 48 has a rim 48*a* extending to the left that is integrally joined to housing 42 and projects out of the plane of opening 44. As shall be described in greater detail below, brake drum 82 of brake unit 80 is placed upon said rim 48*a* of through hole 48. A ball bearing or roller bearing may also be disposed inside through hole 48 should this prove necessary, said bearing enabling the tension compensation device 40 to rotate or pivot easily about the rotational axis of rotary axle device 30 and about the rotational and central longitudinal axis M of rotary axle device 30. In principle, said bearing may also take the form of a sliding bearing.

Above through hole 48, the first opening 44 has an at least approximately C-shaped slot 50 positioned such that it surrounds through hole 48 above said through hole across an angle of at least approximately 180°. Slot 50, the ends of which are rounded, is provided so that components of brake unit 80 are granted the freedom of movement they require when tension compensation device 40 is pivoted. Any cables, for example for the aforementioned photoelectric barriers, can also be passed through slot 50.

The first opening 44 also has an additional, substantially vertical slot 52 disposed above through hole 48 and likewise above the C-shaped slot 50, and spaced apart from the latter. Said slot 52, which extends at least approximately along the vertical axis of symmetry of housing 42 and is disposed in the area of a material reinforcement, not marked, of housing 42, serves to receive a guide element 94, described in greater detail below, of brake unit 80, and which serves in turns to actuate brake unit 80.

The aforementioned guide and deflection roller 54 for guiding the web of material and label carrier web is disposed at the lowermost corner of the kite-shaped housing 42. Said roller 54, which projects substantially perpendicularly from housing 42 out of the plane of surface 42*c* in a forwards direction, as viewed in FIG. 2, is slid rotatably onto an axle, not marked, that is rigidly connected to housing 42, and in such a way that the roller is axially secured. If necessary, roller 54 can be provided with a coating, for example of rubber, for preventing damage to the label carrier web.

Force unit 60, which is disposed inside the second opening 46, consists first of all of a helical compression spring 62 that preferably has a progressive spring rate. Helical compression spring 62 is pushed onto a guide rod 64, the outer diameter of which is at least approximately equal to the inner diameter of compression spring 62. Compression spring 62 is also enclosed by a spring housing 66 such that any buckling of the helical compression spring 62 is securely prevented. Guide rod 64 and spring housing 66 are each provided at the ends facing away from compression spring 62 with a first and a second fixing element 64*a*, 66*a* of force unit 60.

The first fixing element 64*a*, with which helical compression spring 62 props itself at housing 42 of tension compensation device 40 against the support and force application point 65, is formed by a pivot pin, not separately marked, that extends substantially horizontally in FIG. 2. The pivot pin is received in the second opening 46 in the region of the lowermost corner of the kite-shaped housing 42 in a matching hole that preferably coincides with the hole for receiving the axle of guide roller 54. If necessary, the axle of guide roller 54 and the pivot pin can be identical. Force unit 60 is pivotably mounted on housing 42 using the pivot pin of the first fixing element 64*a*, i.e. it can pivot in the plane of the second opening 46.

As can be seen from FIG. 4, the central longitudinal axis of force unit 60 forms an angle with the axis of symmetry and diagonal of the kite-shaped housing 42, which axis is shown as vertical in FIG. 4 and intersects the rotational and central longitudinal axis M. If a vectoral resolution of the force produced by force unit 60 is performed at the apex of said angle or at force application point 65, one result is a force component acting at right angles to the vertical diagonal of housing 42. This force component induces a torque on the tension compensation device 40 about the rotational and central longitudinal axis M, over the support spacing between the force application point 65 of force unit 60 and the rotational and central longitudinal axis M, which coincides with the vertical diagonal of housing 42. These force components are therefore referred to also as torque force components of force unit 60.

Figures 5A, 5B, 5C, 5D, 5E, 5F:
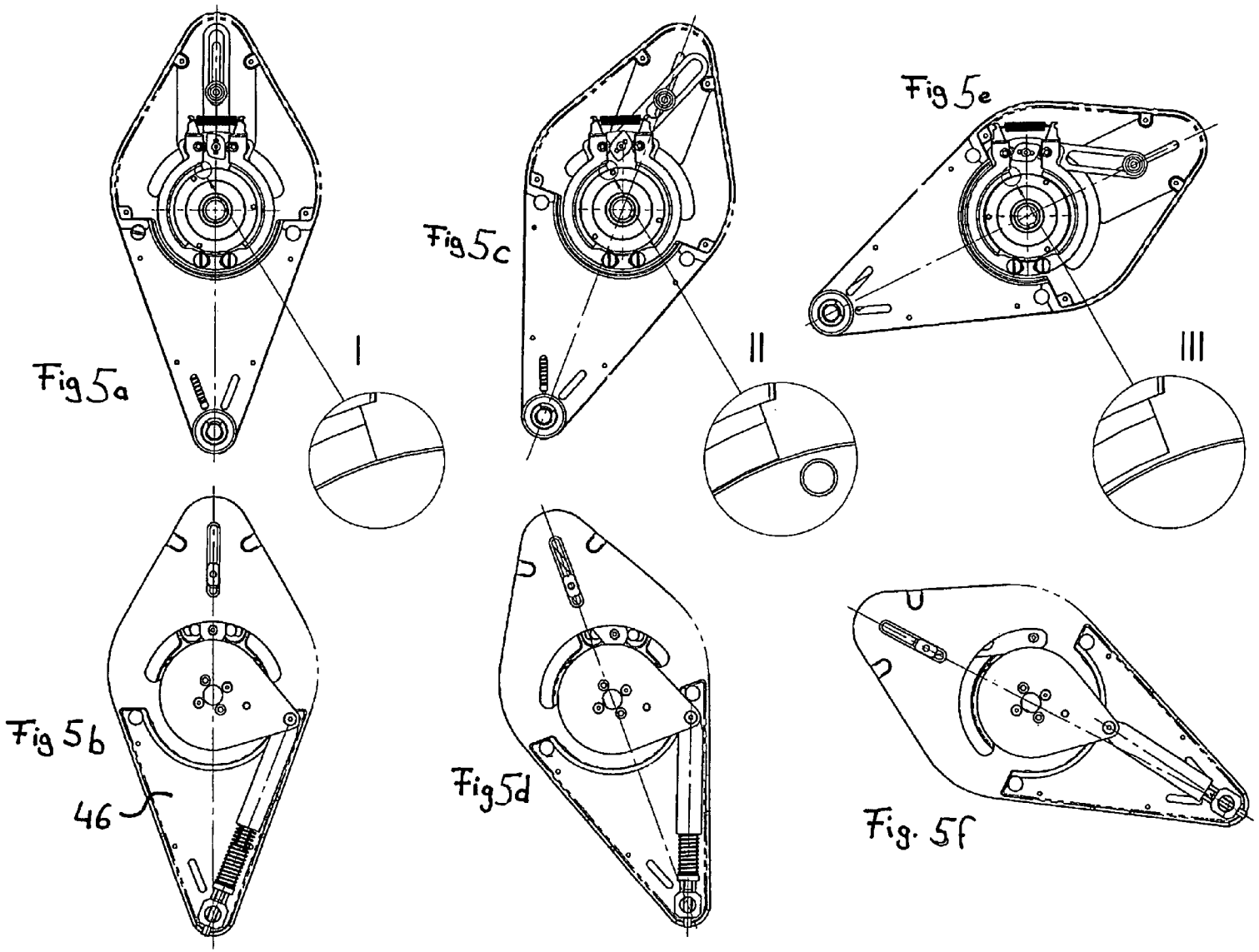

The angle between the vertical symmetry line or diagonal of the kite-shaped housing 42 in FIG. 4, which intersects the rotational and central longitudinal axis M, and the central longitudinal axis of force unit 60 can change when tension compensation device 40 is pivoting, and in particular can decrease with respect to the starting position of tension compensation device 40 (cf. FIGS. 5*b*, 5*d*, 5*f*). By this means, the aforementioned torque force components of the force produced by force unit 60 and acting along the center line of force unit 60 can be kept at least approximately constant, even though the force produced by force unit 60 increases due to the progressive spring rate. As a result, an at least approximately constant torque is generated over the entire pivot range of tension compensation device 40 and counteracts the deflection of said device.

As already mentioned, the second fixing element 66*a* of force unit 60 is provided at the free end of spring housing 66. Force unit 60 is pivotably linked by means of this second fixing element 66*a* to an attachment unit 68 belonging to force unit 60. Said attachment unit 68 takes the form of a disk that in the plan view is shaped at least approximately like a water droplet. Disk 68, the thickness of which is much smaller than its diameter and which can be made of steel, is provided with a through hole 68*a* at its center, by means of which disk 68 is slipped onto the rotational axis of the rotary axle device 30 and therefore disposed concentrically to the rotational and central longitudinal axis M. Support unit 68 is disposed on the rotational axis of the rotary axle device 30 in such a way that attachment unit 68 is both axially and radially fixated relative to the rotary axle.

As can be seen from FIG. 4, in particular, attachment unit 68 has four holes 68*b* concentrically arranged about the rotational and central longitudinal axis M, by means of which holes the attachment unit 68 can be non-rotatably mounted on the housing of labeling machine E, not shown in this Figure, or to any other mounting frame in equipment to which the apparatus 10 according to the invention is mounted. Given the fact, already explained above, that the apparatus 10 according to the invention can be disposed in any position, the four through holes 68*b* are only ever used in pairs. When the attachment unit 68 is oriented as shown in FIG. 4, only the two through holes 68*b* disposed at the bottom left and top right are used. If force unit 60 in opening 46 is disposed on the other side, in relation to FIG. 4, then the two other through holes 68*b* are used, i.e. the through holes 68*b* shown momentarily in FIG. 4 at the top left and bottom right.

Support unit 68 also comprises the extension portion 68*c* that gives it its drop-like shape. Said extension portion 68*c* extends radially outwards on attachment unit 68 and serves to couple or support force unit 60 to coupling point 69 by means of its upper fixing element 66*a*. The coupling point or support and force application point 69 is defined as the point where the central longitudinal axis of a through hole in extension 68*c*, into which a pivot pin, not shown, for pivotably connecting fixing element 66*a* to attachment unit 68 can be inserted, intersects the plane of attachment unit 68.

As has already been explained in the foregoing, the force induced by the helical compression spring 62, the vector or direction of which extends along the central longitudinal axis of the helical compression spring 62, can be resolved at force application point 65 into single force components using a parallelogram of forces or a triangle of forces. One of these components forms the torque force component that induces a torque which acts on the tension compensation device 40. As can be seen by comparing FIGS. 5*b*, 5*d* and 5*f*, in particular, the angle between the vertical symmetry line or diagonal of the kite-shaped housing 42 in FIG. 4, which intersects the rotational and central longitudinal axis M, and the central longitudinal axis of force unit 60 changes when tension compensation device 40 pivots in such a way that the angle decreases in size. This occurs when the helical compression spring supports itself, on the one hand, against its force application point 65 on guide roller 54 and hence on the longer diagonal of the kite-shaped housing 42 that passes through the rotational and central longitudinal axis M, and on the other hand eccentrically at extension 68*c* of the attachment unit at a distance from the rotational and central longitudinal axis M. During the pivoting movement of the tension compensation device 40 and housing 42, the force application point 65 remains stationary, whereas force application point 69 moves along a curved path. Simultaneously, as is evident from a comparison of FIGS. 5*b*, 5*d*, 5*f*, the angle between the radius line running between the rotational and central longitudinal axis M and the force application point 65, on the one hand, and the central longitudinal axis of the helical compression spring 62, on the other hand, increases in size. Despite the increasing compressive force resulting from the helical compression spring 62 with progressive spring rate being compressed more and more, the torque force component inducing the torque on housing 42 and which results from the vectoral resolution of the compressive force produced by the helical compression spring 62 remains constant.

Hence, if the apparatus 10 according to the invention and housing 42 are deflected to the right in FIG. 1 out of the starting position in FIG. 1 by the tension acting on the web of material due to the conveyor drive of the printer/dispensing unit DS, then helical compression spring 62 is compressed as a result of this pivoting movement of housing 42. This causes helical compression spring 62 to exert a compressive force, braced against attachment unit 68, on tension compensation device 40, said force counteracting as a torque the pivoting movement of housing 42 out of its starting position. As described in the foregoing, there is a simultaneous decrease in the angle between the central longitudinal axis of force unit 60 and the vertical diagonal of housing 42 in FIG. 4. In other words, the resulting torque remains at least approximately constant over the entire range of pivoting movement of housing 42, such that the tension exerted on the web of material likewise remains at least approximately constant.

The apparatus 10 according to the invention also comprises a brake unit 80 disposed in the first opening 44 of housing 42. Brake unit 80 has a brake drum 82 that is concentric to and rotatable on the rotational axis of the rotary axle device 30. There is a rotating union between brake drum 82 and the tension compensation device 40, or its housing 42, such that when housing 42 rotates or pivots, brake drum 82 is likewise rotated. As can be seen from FIG. 2, brake drum 82 has a sufficiently wide, cylindrical lateral perimeter surface 82*a* that serves as a contact surface or counter-surface for the two brake shoes 84 of brake unit 80, which are described in more detail below.

Brake unit 80 also comprises the aforementioned brake shoes 84, which are arranged symmetrically to brake drum 82 and hence symmetrically to the rotational and central longitudinal axis M of apparatus 10 according to the invention and to the rotary axle device 30. Brake shoes 84 have the usual outer contours, i.e. they have the shape of an arc extending over at least approximately 180°. On the side facing brake drum 82, they each have a brake pad 84*a*. At their lower ends 84*b* , they are pivotably coupled by means of suitable head bolts 85 through oval through holes 36*a* to support plate 32 of rotary axle device 30. At their upper ends 84*c*, they are guided by means of similarly suitable head bolts, not marked, in the two longitudinal slots 38*a* of support plate 32. This makes it possible for the two brake shoes 84 to be pivoted about their two lower rotational axes in a radially outward direction, relative to brake drum 82, such that brake unit 80 can be moved from the braked position, in which brake shoes 84 are firmly in contact with the cylindrical outer perimeter surface 82*a* of brake drum 82, into a released position, in which the two brake shoes 84 are at a distance from the cylindrical perimeter surface 82*a* of brake drum 82. In the released position, brake unit 80 does not have any braking effect on brake drum 82 and hence on the tension compensation device 40 or on the entire apparatus 10 according to the invention.

The two brake shoes 84 are biased into the braked position by a tension spring 86 attached to brake shoes 84 at their upper ends 84*c*. In order to move brake shoes 84 reversibly from the braked position into the released position, a rocker 88 is provided between the two upper ends 84*c* of brake shoes 84. Rocker 88 is provided with cam surfaces 88*a* on the sides facing brake shoes 84. Cam surfaces 88*a* come into contact with two ball bearings 90 that are slid onto and axially secured to the guide pins by means of which brake shoes 84 are guided inside longitudinal slots 38*a* of support plate 32. As is evident from FIG. 2, ball bearings 90 are each inserted in a slot in the side end 84*c* of brake shoes 84. The outer bearing rings of ball bearings 90, not marked in the drawing, form the counter-surfaces to the cam surfaces 88*a* of rocker 88 and can roll on said surfaces.

In the plan view, i.e. in the view from the front, rocker 88 has the shape of a parallelogram with rounded corners. Rocker 88 is also joined non-rotatably and axially rigidly to a head pivot pin 91 that can be rotatably inserted into through hole 38*b* of support plate 32*b*. Rocker 88 can be pivoted approx. 90° out of the braked position, shown in FIG. 2, to a released position, shown in FIG. 5*c*.

A lever 92 for pivoting rocker 88 is provided, said lever 92 being rotatably joined at its lower end 92*a* to rocker 88 and having a longitudinal slot 92*b* at its upper end. A guide block 94 engages with said longitudinal slot 92 and can be positioned in the longitudinal slot 52 in the upper opening 44 of housing 42 in order to change the changeover point of brake unit 80. When housing 42 or tension compensation device 40 is pivoted, lever 92 is likewise pivoted about its rotational axis by the actuating connection formed by guide block 94 and lever 92, whereupon rocker 88 is pivoted, in turn. By this means, the cam surfaces 88*a* of rocker 88 come into contact with ball bearings 90. Due to the parallelogram shape of rocker 88, any further pivoting of housing 42 presses the two upper ends 84*c* of brake shoes 84 apart, with the result that the brake is released. When housing 42 returns to its starting position, rocker 88 rotates back to Its starting position, such that brake shoes 84 are made to return to their starting, i.e. braked position by the force of the tension spring 86.

It should be noted, finally, that tension compensation device 40 and housing 42 and the components or assemblies received therein are disposed relative to each other and hence with a weight relation to each other in such a way that tension compensation device 40 is practically weight-neutral in relation to the rotational and central longitudinal axis M. In other words, irrespective of its rotational state, tension compensation device 40 is in a state of stable equilibrium relative to the rotational and central longitudinal axis M, and therefore at rest. As a result, apparatus 10 according to the invention can be installed in any desired position.

The operation of apparatus 10 according to the invention shall now be described with reference to the drawings in FIGS. 5*a*-5*f*.

FIGS. 5*a*-5*f* show the tension compensation device 40 in a front and rear view, with FIGS. 5*a*, 5*b* and 5*c*, 5*d* and 5*e*, 5*f* each forming pairs, i.e. FIGS. 5*a*, 5*b* show the tension compensation device 40 in the same position viewed from the front and rear side. The same applies to FIGS. 5*c*, 5*d* and FIGS. 5*e*, 5*f*. Enlarged details are also shown between the respective pairs of FIGS. 5*a*, 5*b* and 5*c*, 5*d* and 5*e*, 5*f*, said details being marked I.-III.

In FIGS. 5*a*, 5*b*, apparatus 10 according to the invention and tension compensation device 40 are shown in its starting position. It should be noted in this context that said starting position is not identical in its angular position to the starting position of apparatus 10 according to the invention and tension compensation device 40 as shown in FIG. 1, but this has no influence on the way that it operates.

Apparatus 10 according to the invention adopts the starting position in particular when the web of material is not being transported, and machine E, in which apparatus 10 according to the invention is being used, is not in operation. The brake unit 80 is in its braked position here, as also shown in Detail I.

If the machine in which apparatus 10 according to the invention is disposed, for example labeling machine E, is now put into operation, drive rollers of printer/dispensing unit DS, not marked, wind the label carrier web off unwinding unit 20. The label carrier web moves from the left around guide roller 54 of tension compensation device 40. Due to the tension exerted on the web of material by the drive rollers of printer/dispensing unit DS, tension compensation device 40 is simultaneously pivoted to the left (or to the right in FIG. 2), as shown in FIGS. 5*c*, 5*d*. Force unit 60 is actuated in the process in such a way that compression spring 62 is compressed. This occurs because pivoting of tension compensation device 40 causes force application point 65 to moves to the right, as shown in FIG. 5*d*. Since helical compression spring 62 is unable to avoid being compressed, due to fact that is attached at its upper end 66*a* to the stationary attachment unit 68, the helical compression spring 62 must shrink in size. This induces the torque force component that acts on force application point 65, said torque force component exerting a torque on the tension compensation device 40 across the support spacing between the force application point 65 and the rotational and central longitudinal axis M, counteracting the deflection of device 40.

Lever 92 is also pivoted to the left from its vertical starting position, because the housing 42 of tension compensation device 40 is likewise pivoted to the left. Since rocker 88 and its rotational axis, not marked, remain stationary, lever 92 is pivoted, whereupon rocker 88 begins to turn, causing brake shoes 84 to be moved out of their braked position, as shown in Detail II, inter alia.

If there is any further increase in the tension, the tension compensation device 40 is able to pivot into the position shown in FIGS. 5*e*, 5*f*. As shown in Detail III, brake unit 80 is then completely open, i.e. brake shoes 84 are completely raised from the cylindrical outer perimeter surface 82*a* of brake drum 80. Tension compensation device 40 has continued to turn at the same time, with the result that, as already described above, the helical compression spring 62 is further compressed because it is unable to avoid compression due to its being stationarily fixated at its upper end 66*a*. In this position, the helical compression spring 62 exerts its greatest compressive force on the tension compensation device 40 or apparatus 10 according to the invention. Due to the fact that the angle between the central longitudinal axis of the force unit 60 and the support spacing, or the longer diagonal of housing 42 decreases, and that the angle between the central longitudinal axis of force unit 60 and the spacing between the rotational and central longitudinal axis M and the force application point 69 increases, the torque remains the same as in the situation shown in FIGS. 5*a*, 5*b* and in FIGS. 5*c*, 5*d*. On the whole, therefore, a constant torque is exerted on apparatus 10 according to the invention.

If transportation of the web of material is interrupted, and in particular if no tension is exerted on the web of material, the components return to their starting position due to the effect of helical compression spring 62 and tension spring 86.

The invention claimed is:

1. An apparatus for maintaining a constant tension on a web of material, said apparatus comprising:

a stationary rotary axle device with a geometric rotational axis; and a tension compensation device rotatable from a starting position about said rotational axis of said rotary axle device, said tension compensation device including a housing having at least one cavity formed therein and a force unit arranged at least partially inside said cavity which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device.

2. The apparatus according to claim 1, wherein the force unit is pivotable at the force application point relative to the tension compensation device.

3. The apparatus according to claim 1, wherein the size of the force produced by the force unit changes at least section by section along the path of rotational movement of the tension compensation device.

4. The apparatus according to claim 3, wherein the size of the force produced by the force unit changes continuously along the path of rotational movement of the tension compensation device.

5. The apparatus according to claim 3, wherein the size of the force produced by the force unit increases continuously along the path of rotational movement of the tension compensation device.

6. The apparatus according to claim 1, wherein the force produced by the force unit is a compressive force.

7. The apparatus according to claim 1, wherein the force produced by the force unit is a tensile force.

8. The apparatus according to claim 1, wherein the force unit is formed by at least one spring.

9. The apparatus according to claim 8, wherein the spring is a pressure spring with a nonlinear, progressive spring rate.

10. The apparatus according to claim 1, wherein the weight distribution of the tension compensation device is symmetrical with respect to the rotational axis of the rotary axle device.

11. An apparatus for maintaining a constant tension on a web of material, in particular on a label web used in a labeling machine, said apparatus comprising:

a stationary rotary axle device with a geometric rotational axis; and a tension compensation device rotatable from a starting position about said rotational axis of said rotary axle device, said tension compensation device comprising a force unit which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device;

wherein the angle between the line of force of the linear force produced by the force unit, and the radial spacing between the rotational axis and the force application point can be modified.

12. The apparatus according to claim 11, wherein the angle between the line of force of the linear force produced by the force unit, and the radial spacing between the rotational axis and the force application point can be continuously modified.

13. The apparatus according to claim 11, wherein the angle between the line of force of the linear force produced by the force unit, and the radial spacing between the rotational axis and the force application point can be modified in such a way that it becomes smaller.

14. An apparatus for maintaining a constant tension on a web of material, in particular on a label web used in a labeling machine, said apparatus comprising:

a stationary rotary axle device with a geometric rotational axis; and a tension compensation device rotatable from a starting position about said rotational axis of said rotary axle device, said tension compensation device comprising a force unit which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device;

wherein the size of the components of the force produced by the force unit, and which causes a torque to act on the tension compensation device across the radial spacing between the rotational axis of the rotary axle device and the force application point of the tension compensation device, remains constant while the tension compensation device is rotating.

15. An apparatus for maintaining a constant tension on a web of material, in particular on a label web used in a labeling machine, said apparatus comprising:

a stationary rotary axle device with a geometric rotational axis; and a tension compensation device rotatable from a starting position about said rotational axis of said rotary axle device, said tension compensation device comprising a force unit which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device;

wherein the tension compensation device further comprises a stationary attachment unit on which an attachment point for the force unit is provided eccentrically to the rotational axis of the rotary axle device.

16. An apparatus for maintaining a constant tension on a web of material, in particular on a label web used in a labeling machine, said apparatus comprising:

a stationary rotary axle device with a geometric rotational axis;

a tension compensation device rotatable from a starting position about said rotational axis of said rotary axle device, said tension compensation device comprising a force unit which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device; and at least one unwinding unit which is held on the rotary axle device such that said unwinding unit is rotatable about the rotational axis of said device.

17. The apparatus according to claim 16, wherein the unwinding unit is held axially rigid on the rotary axle device.

18. The apparatus according to claim 16, wherein the unwinding unit comprises fastening means for fastening the winding material in a substantially slip-free, reversible manner.

19. An apparatus for maintaining a constant tension on a web of material, in particular on a label web used in a labeling machine, said apparatus comprising:

a stationary rotary axle device with a geometric rotational axis;

a tension compensation device rotatable from a starting position about said rotational axis of said rotary axle device, said tension compensation device comprising a force unit which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device; and a stationary brake unit whose breaking power acts upon an unwinding unit.

20. The apparatus according to claim 19, wherein the brake unit is in its braking position when the tension compensation device is in its starting position.

21. The apparatus according to claim 19, wherein the brake unit is reversibly movable from its braked position into its released position by means of at least one actuating element connected for transmission of motion to the tension compensation device.

22. The apparatus according to claim 21, wherein the actuating element communicates with the tension compensation device such that the actuating element can be adjusted by the rotational movement of the tension compensation device.

23. The apparatus according to claim 21, wherein characterized in that the actuating element acts directly upon at least one brake shoe of the brake unit.

24. The apparatus according to claim 21, wherein the actuating element formed by a cam element.

25. The apparatus according to claim 24, wherein the cam element has a cam surface with a surface profile that is continuous but uneven.

26. The apparatus according to claim 19, wherein the brake unit can be released from its braked position when the rotational movement of the tension compensation device begins.

27. The apparatus according to claim 26, wherein the brake unit is released continuously from its brake position.

28. The apparatus according to claim 19, wherein the brake unit is biased into its braked position by means of at least one biasing element.

29. The apparatus according to claim 28, wherein the biasing force of the biasing element is matched to the force produced by the force unit such that the biasing force can be added to the latter force.

30. The apparatus according to claim 28, wherein the biasing force can be applied to the brake unit by means of a spring element.

31. The apparatus according to claim 19, wherein the brake unit is formed by a shoe-type brake of which at least one brake shoe is rigidly connected to the rotary axle device, the brake shoe acting upon a brake drum connected non-rotatably to the unwinding unit.

32. The apparatus according to claim 31, wherein characterized in that the brake drum is rotatably disposed concentrically to the rotary axis of the rotary axle device and the brake unit comprises two brake shoes provided symmetrically to the brake drum.

33. The apparatus according to claim 32, wherein the brake shoes are biased by at least one tension spring into the braked position of the brake unit.

34. An apparatus for maintaining a constant tension on a web of material, in particular on a label web used in a labeling machine, said apparatus comprising:

a stationary rotary axle device with a geometric rotational axis; and a tension compensation device rotatable from a starting position about said rotational axis of said rotary axle device, said tension compensation device comprising a force unit which exerts a force on the tension compensation device that counteracts the rotational movement of the tension compensation device from the starting position, wherein the force applied by the force unit is a linear force acting on the tension compensation device at a force application point with a radial spacing to the rotational axis of the rotary axle device;

wherein characterized in that the tension compensation device further includes a housing which encloses components of the rotary axle device at least partially.

35. The apparatus according to claim 34, wherein the rotational axis of the rotary axle device lies within the housing.

36. The apparatus according to claim 34, wherein characterized in that the housing in a plan view has the shape of at least one of a rectangle, a rhombus, and a kite.

37. An apparatus for maintaining substantially constant tension on a web, the apparatus comprising:

a tension control housing rotatably mounted about a rotational axis for movement away from and toward a starting position;

an unwinding device mounted to the housing, the unwinding device being capable of supporting a web supply roll;

a deflection roll mounted to the housing and spaced from the rotational axis, wherein the web can pass from the supply roll and exert force against the deflection roll to move the housing as tension in the web increases;

a spring mounted to the housing to exert a force that counteracts the rotational movement of the housing as tension on the web increases; and a brake operable in the starting position and releasable as the housing moves away from the starting position.

38. The apparatus according to claim 37, wherein the apparatus includes one and only one deflection roll.

* * * * *

UNITED STATES PATENT AND TRADEMARK OFFICE

CERTIFICATE OF CORRECTION

PATENT NO. : 7,543,773 B2
APPLICATION NO. : 11/323326
DATED : December 30, 2005
INVENTOR(S) : Johannes Lenkl It is certified that error appears in the above-identified patent and that said Letters Patent is hereby corrected as shown below:

In claim 23, column 17, line 34, after --wherein-- delete "characterized in that"

In claim 32, column 18, line 6, after --wherein-- delete "characterized in that"

In claim 34, column 18, line 29, after --wherein-- delete "characterized in that"

Signed and Sealed this

Twenty-fifth Day of August, 2009

David J. Kappos

David J. Kappos
*Director of the United States Patent and Trademark Office*